United States Patent [19]

Hirai

[11] Patent Number: 4,876,171

[45] Date of Patent: Oct. 24, 1989

[54] SILVER SALT DIFFUSION TRANSFER WITH COMPLEXING COMPOUND

[75] Inventor: Hiroyuki Hirai, Kanagawa, Japan

[73] Assignee: Fuji Photo Film Co., Ltd., Kanagawa, Japan

[21] Appl. No.: 155,470

[22] Filed: Feb. 12, 1988

[30] Foreign Application Priority Data

Feb. 13, 1987 [JP] Japan ..... 62-31184

[51] Int. Cl.[4] ..... G03C 5/54

[52] U.S. Cl. ..... 430/203; 430/247; 430/249; 430/251; 430/955

[58] Field of Search ..... 430/203, 251, 231, 247, 430/249, 955

[56] References Cited

U.S. PATENT DOCUMENTS

| | | | |
|---|---|---|---|
| 4,168,166 | 9/1979 | Land | 430/251 |
| 4,639,407 | 1/1987 | Aono et al. | 430/203 |
| 4,740,363 | 4/1988 | Hirai et al. | 430/203 |
| 4,740,445 | 4/1988 | Hirai et al. | 430/203 |

FOREIGN PATENT DOCUMENTS 62-283332 2/1987 Japan .

OTHER PUBLICATIONS

Chem. Abst. No. 109: 83250z, 1988, Abstract of Japanese Publication No. 62/283,332.

*Primary Examiner*—Richard L. Schilling
*Attorney, Agent, or Firm*—Sughrue, Mion, Zinn, Macpeak & Seas

[57] ABSTRACT

A photographic image is formed on an image-receiving material by imagewise exposing a silver halide photosensitive material, placing the exposed material on an image-receiving material, and subjecting the assembly to silver salt diffusion transfer in the presence of a reducing agent, a physical development nucleus, a complexing compound capable of complexing reaction with a silver ion in the presence of water and/or a hydrophilic thermal solvent as a medium, and optionally, a substantially water-insoluble basic metal compound.

13 Claims, No Drawings

SILVER SALT DIFFUSION TRANSFER WITH COMPLEXING COMPOUND

BACKGROUND OF THE INVENTION

This invention relates to a method for forming photographic images by silver salt diffusion transfer.

The principle of silver salt diffusion transfer process is described in U.S. Pat. No. 2,352,014.

The silver salt diffusion transfer process generally uses a photosensitive material and an image-receiving material. The photosensitive material which has a silver halide base emulsion layer is exposed imagewise and then combined with the image-receiving material such that the exposed emulsion layer faces the receiving surface of the latter. The assembly is immersed in a developer solution, squeezed of excess solution, and allowed to stand for a little while. Those portions of the silver halide in the photosensitive material which have been fully exposed are developed by the action of the developer. The unexposed silver halide portions are solubilized by the action of a silver halide solvent, diffused into the image-receiving material, and reduced in the presence of physical development nuclei into silver to form a positive image.

This process utilizes an alkali-containing developer, which would be hazardous to the hands and cloths and cause corrosion of a developing machine. Handling of developing chemicals and maintenance of developer solution require some skill, and the process is cumbersome as a whole.

A number of methods for forming positive images by heating have been proposed to overcome these drawbacks. It is, however, fairly difficult to solubilize a silver halide with a silver halide solvent solely by applying heat. Also, it takes a time to transfer the solubilized silver salt onto an image-receiving material with the aid of heat only. A hydrophilic thermal solvent is used to promote transfer of a mobile silver salt as described in Japanese Patent Application Kokai No. 60-194448.

The silver halide solvents described in these methods have problems of suppressing development, discoloring a silver image on an image-receiving material, and so on.

SUMMARY OF THE INVENTION

An object of the present invention is to provide a novel and improved method for forming a high density and high sensitivity silver image in a simple manner within a short time while insuring ease of maintenance of a processing machine and a processing solution.

According to the present invention, there is provided a method for forming an image, comprising subjecting a photographic material comprising a silver halide photosensitive material and an image-receiving material to a silver salt diffusion transfer process in the presence of a reducing agent, a physical development nucleus, and a complexing compound capable of complexing reaction with a silver ion in the presence of water and/or a hydrophilic thermal solvent as a medium.

DETAILED DESCRIPTION OF THE INVENTION

According to the image forming method of the present invention, a photographic material comprising a silver halide base photosensitive material and an image-receiving material is subjected to a silver salt diffusion transfer process in the presence of a reducing agent, a physical development nucleus, and a complexing compound.

The complexing compound used in the present invention is capable of forming with a silver ion a complex salt having a stability constant of at least 1 at 25° C. and pH 9 as expressed in logK.

These complexing compounds are detailed in A.E. Martell & R. M. Smith, "Critical Stability Constants", Vols. 1–5, Plenum Press, inter alia.

Illustrative examples of the complexing compounds include salts of aminocarboxylic acids, iminodiacetic acids, anilinecarboxylic acids, pyridinecarboxylic acids, aminophosphoric acids, carboxylic acids (including mono, di-, tri-, and tetracarboxylic acids, and their derivatives having a substituent such as phosphono, hydroxy, oxo, ester, amide, alkoxy, mercapto, alkylthio, and phosphino), hydroxamic acids, polyacrylic acids, and polyphosphoric acids with alkali metals, guanidines, amidines, and quaternary ammonium.

Preferred, non-limiting examples of the complexing compounds are salts of picolinic acid, 2,6-pyridinedicarboxylic acid, 2,5-pyridinedicarboxylic acid, 4-dimethylaminopyridine-2,6-dicarboxylic acid, quinoline-2carboxylic acid, 2-pyridylacetic acid, oxalic acid, citric acid, tartaric acid, isocitric acid, malic acid, gluconic acid, EDTA (ethylenediaminetetraacetic acid), NTA (nitrilotriacetic acid), CDTA (1,2-cyclohexanediaminetetraacetic acid), hexametaphosphoric acid, tripolyphosphoric acid, tetraphosphoric acid, polyacrylic acid, and acids of the following chemical formulae:

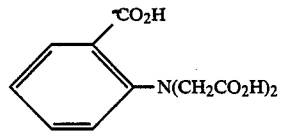

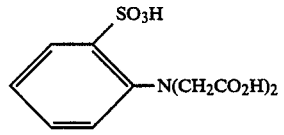

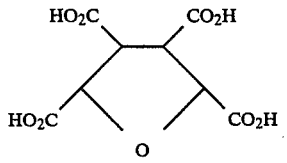

$HO_2CCH_2OCH_2CH_2OCH_2CO_2H$,
$HO_2CCH_2OCH_2CO_2H$,

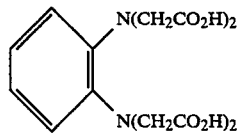

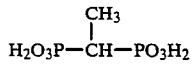

with alkali metals, guanidines, amidines, and quaternary ammonium.

Preferred among others are those aromatic heterocylic compounds having at least one —COOM and containing one nitrogen atom in their ring wherein M is selected from ions of alkali metals, guanidines, amidines, and quaternary ammonium. The ring contained therein may be a single ring or a fused ring such as a pyridine ring and a quinoline ring. The position at which —COOM is attached to the ring is most preferably the α-position of the ring relative to the N atom.

More preferred compounds are those represented by the following formula:

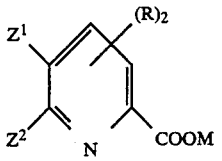

In the above formula, R represents an electron donative radical selected from hydrogen atom, aryl radicals, halogen atoms, alkoxy radicals, —COOM, hydroxycarbonyl radical, amino and substituted amino radicals, and alkyl radicals. The two R's may be the same or different. $Z^1$ and $Z^2$ are as defined for R and may be combined together to form a ring fused to the pyridine ring. M is as defined above.

The complexing compounds may be used alone or in admixture of two or more. They may also be used in combination with a known silver halide solvent.

In the practice of the present invention, it is preferred to use a substantially water-insoluble basic metal compound in combination with the complexing compound. Since the substantially water-insoluble basic metal compound reacts with the complexing compound in the presence of water or a hydrophilic thermal solvent to release a base to increase the pH of the system, an image can be formed without using an alkaline agent with the result of ease of handling.

I have discovered that an image can be formed by carrying out silver salt diffusion transfer is carried out in the presence of a reducing agent and a silver halide solvent while using a substantially water-insoluble basic metal compound and a complexing compound (Japanese Patent Application No. 61-85760). This method is effective in forming an image of quality. Continuing research, I have found that a silver halide solvent which is otherewise used can be eliminated in this process because a complexing compound can also serve as a silver halide solvent. The present invention is based on this finding.

The substantially water-insoluble basic metal compounds used in the present invention are those compounds having a solubility in water at 20° C. of up to 0.5 as expressed in grams of the compound dissolvable in 100 grams of water. They are represented by the general formula:

$$T_mX_n$$

wherein T is a transition metal such as Zn, Ni, Al, Co, Fe, Mn, etc. or an alkaline earth metal such as Ca, Ba, Mg, etc.; X is a member that can form in water a counter ion to M as previously described in conjunction with the complexing compound and exhibits alkaline nature, for example, a carbonate ion, phosphate ion, silicate ion, borate ion, aluminate ion, hydroxy ion, and oxygen atom; and m and n are such integers as to establish equilibrium between the valences of T and X.

Some preferred, non-limiting examples of the substantially water-insoluble basic metal compounds include calcium carbonate, barium carbonate, magnesium carbonate, zinc carbonate, strontium carbonate, magnesium calcium carbonate $CaMg(CO_3)_2$; magnesium oxide, zinc oxide, tin oxide, cobalt oxide; zinc hydroxide, aluminum hydroxide, magnesium hydroxide, calcium hydroxide, antimony hydroxide, tin hydroxide, iron hydroxide, bismuth hydroxide, manganese hydroxide; calcium phosphate, magnesium phosphate; magnesium borate; calcium silicate, magnesium silicate; zinc aluminate, calcium aluminate; basic zinc carbonate $2ZnCO_3.3Zn(OH)_2.H_2O$, basic magnesium carbonate $3MgCO_3.Mg(OH)_2.3H_2O$, basic nickel carbonate $NiCO_3.\ 2Ni(OH)_2$, basic bismuth carbonate $Bi_2(CO_3)O_2.H_2O$, basic cobalt carbonate $2CoCO_3.3Co(OH)_2$, and aluminum magnesium oxide. Most preferred among them are uncolored compounds.

Examples of the most preferred combinations of the substantially water-insoluble basic metal compounds and the complexing compounds are illustrated below. In the following formulae, $M^{\oplus}$ *represents an alkali metal ion, substituted or unsubstituted guanidinium ion, amidinium ion, or quaternary ammonium ion.*

| Substantially insoluble compound | Complexing compound |
|---|---|
| Calcium carbonate | 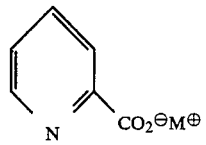  |
| Basic zinc carbonate | 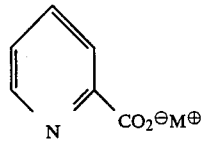  |
| Basic magnesium carbonate | 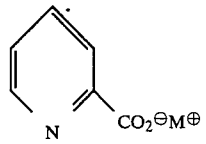  |
| Zinc oxide | 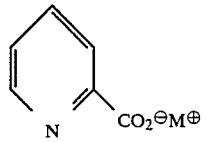  |
| Zinc hydroxide | 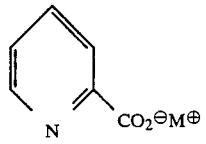  |
| Aluminum hydroxide | 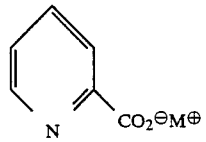  |

-continued

| Substantially insoluble compound | Complexing compound |
|---|---|
| Basic zinc carbonate | 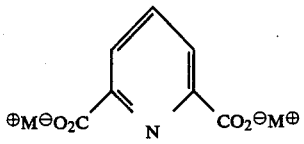 |
| Basic magnesium carbonate | 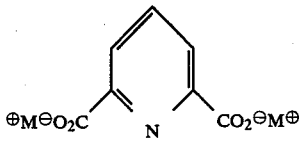 |
| Calcium carbonate | 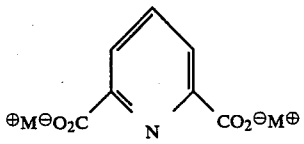 |
| Zinc oxide | 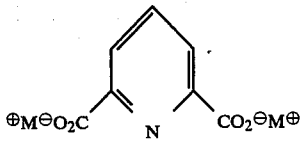 |
| Zinc oxide | $3M^{\oplus}$ salt of EDTA |
| Zinc hydroxide | $3M^{\oplus}$ salt of CDTA |
| Calcium carbonate | 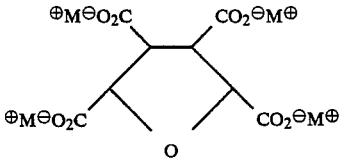 |
| Calcium carbonate | 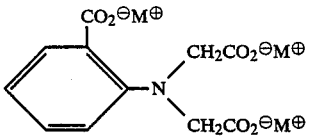 |
| Magnesium oxide | 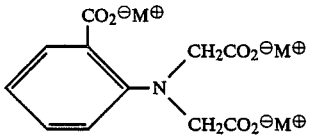 |
| Zinc hydroxide | 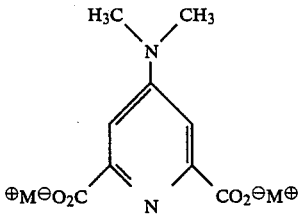 |

-continued

| Substantially insoluble compound | Complexing compound |
|---|---|
| Tin hydroxide | 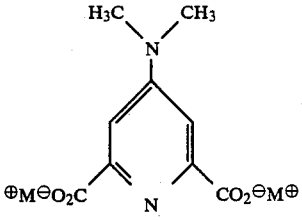 |
| Calcium carbonate | 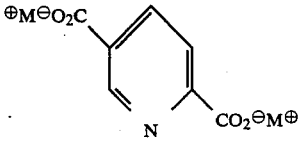 |
| Calcium carbonate | 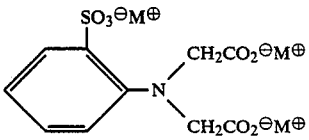 |
| Basic zinc carbonate | 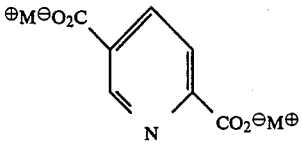 |

These combinations may be used alone or in admixture of two or more. These compounds may also be used in combination with any well-known base or base precursor.

The amount of the complexing compound added to a layer on a support depends on the type of complexing compound, grain size of silver halide and organic silver salt, complexing reaction rate, and other factors, but is preferably at most 50% by weight, more preferably from 0.01 to 40% by weight based on the weight of each coating layer. Where the complexing compound is supplied as a solution in water or developer solution which participates in the relevant process, a concentration of from 0.005 to 10 mol/liter, particularly from 0.05 to 5 mol/liter is preferred. The content of the complexing compound in the photographic material or an aqueous solution which participates in the relevant process preferably ranges from 1/100 to 100 mols, more preferably from 1/10 to 20 mols per mol of silver ion in the photosensitive material.

When a substantially water-insoluble basic metal compound is used in the present invention, the basic metal compound and the complexing compound are introduced such that they react with each other in the presence of water and/or a hydrophilic thermal solvent during diffusion transfer development.

It is desired in the present invention that the substantially water-insoluble basic metal compound and the complexing compound be separately contained in at least one layer on separate supports. For example, the substantially water-insoluble basic metal compound is contained in a photosensitive material while the complexing compound is contained in the image-receiving material. The complexing compound may be supplied as a solution in water which participates in the relevant process. The substantially water-insoluble basic metal compound may be contained as a fine particulate dispersion which is prepared by the methods described in Japanese Patent Application Kokai Nos. 59-174830 and 53-102733. In such dispersions, the compound preferably has an average particle size of 50 μm or less, especially 5 μm or less.

The amount of the basic metal compound added depends on the type and particle size of the compound, type of the complexing compound, and other factors, but is preferably at most 50% by weight, more preferably from 0.01 to 40% by weight based on the weight of the coating layer to which the compound is added. The molar ratio of the basic metal compound to the complexing compound may preferably range from 1:100 to 100:1, more preferably from 1:10 to 10:1.

According to the image forming method of the present invention, a photographic material comprising a silver halide base photosensitive material and an image-receiving material is subjected to silver salt diffusion transfer in the presence of a reducing agent, a physical development nucleus, and a complexing compound. When a substantially water-insoluble basic metal compound is used in the method of the present invention, the complexing compound not only gives rise to complexing reaction to increase the pH of the system, but also serves as a silver halide solvent. Thus the silver halide solvent which is necessary in a conventional process is no longer necessary.

Water used as a medium in the practice of the present invention may be supplied in various ways, as by supplying water from the outside, or incorporating water-containing capsules in a photosensitive material or image-receiving material and breaking the capsules by heating or any other suitable means to thereby make water available. The water used as a medium may be pure water, or may contain an organic solvent such as methanol and ethanol, a hydrophilic thermal solvent as will be described below, or a developer ingredient.

The hydrophilic thermal solvent is a solvent which is solid at room temperature, and becomes liquid at elevated temperatures of about 60° C. or higher. This solvent has an inorganic/organic nature ratio of at least unity (1) and a solubility of at least 1 gram in 100 grams of water at room temperature. With respect to the inorganic/organic nature ratio, reference is made to "Kagaku No Ryouiki" (Range of Chemistry), Vol. 11, 719 (1957), for example. The hydrophilic thermal solvent preferably has an inorganic/organic nature ratio of at least 1.5, most preferably at least 2.

The hydrophilic thermal solvent preferably has a molecular weight of up to 200, more preferably up to 100, and a melting point of from 40° to 250° C., more preferably from 40° to 200° C., most preferably from 40° to 150° C.

Examples of the hydrophilic thermal solvent include ureas, pyridines, amides, sulfonamides, imides, alcohols, oximes, and various heterocyclic compounds. Illustrative examples are described in Japanese Patent Application Kokai No. 59-168439.

The hydrophilic thermal solvent is used by adding to a photosensitive material and/or a dye-fixing material. The amount of the hydrophilic thermal solvent is not particularly limited although the preferred coating amount is in the range of from 5 to 500% by weight, more preferably from 20 to 200% by weight, and most preferably from 30 to 150% by weight based on the total coating amount of the photosensitive material and dye-fixing material (excluding the amount of the hydrophilic thermal solvent)

The hydrophilic thermal solvent is generally dispersed in a binder as a solution in water. It may also be dispersed in a binder as a solution in an alcohol such as methanol and ethanol.

The silver salt diffusion transfer process used herein is generally a silver salt diffusion transfer process carried out at room temperature.

The principle of the silver salt diffusion transfer process is described in U.S. Pat. No. 2,352,014. A silver halide emulsion layer is exposed in correspondence with a certain image. The exposed emulsion layer is placed in contact or arranged to be brought in contact with an image-receiving layer in the presence of a developing agent and a silver halide solvent whereby the unexposed silver halide is converted into a soluble silver complex salt.

The role of this silver halide solvent is played by the complexing compound in the practice of the present invention.

In the portion of a silver halide emulsion layer which has been exposed, the silver halide is developed into silver and is no more dissolvable or diffusible In an unexposed portion of the silver halide emulsion layer, the silver halide is converted into a soluble silver complex salt, which is transferred to the image-receiving material where the salt ordinarily forms a silver image in the presence of physical development nuclei.

In the case of a direct positive silver halide emulsion, the actions of silver halide in exposed and unexposed portions are reversed.

The process can be carried out by heat development. More particularly, a photosensitive material after exposure is heated in the presence of a reducing agent to produce a silver portion and a silver halide portion in accordance with the image. The silver halide reacts with the complexing compound serving as a silver halide solvent, to thereby form a silver salt which is mobile at elevated temperatures. The mobile silver salt is diffused in the image-receiving layer containing physical development nuclei where the silver salt is reduced to produce a silver image.

Preferred among others is a process wherein a photosensitive material containing a photosensitive silver halide and an organic silver salt is heated to a high temperature in the presence of a reducing agent and a complexing compound serving as a silver halide solvent to form a mobile silver salt image which has a negative relationship to the silver image. The mobile silver salt is diffused in a silver salt-fixing layer which contains physical development nuclei at an elevated temperature, to thereby form in the image-receiving layer a silver image which is the same as the mobile silver salt image.

The image-receiving material including an image-receiving layer may be formed either on a separate sheet from the photosensitive material including a silver halide-containing photosensitive layer or on the same sheet as the photosensitive material through an intermediate layer or a reflective layer of titanium oxide, for example.

The mobile silver salt may be transferred by the same step as the silver salt formation. Alternatively, after formation of a mobile silver salt, a photosensitive material is placed on an image-receiving material and then heated to transfer the salt.

A particularly easy and preferred embodiment involves separately forming a photosensitive material containing a substantially water-insoluble basic metal compound and an image-receiving material containing a complexing compound, imagewise exposing the photosensitive material, placing the image-receiving material on the exposed photosensitive material, and uniforming heating the assembly in the presence of water to transfer a mobile silver salt to the image-receiving material to form an image. It is also possible to incorporate a basic metal compound in an image-receiving material and a complexing compound in a photosensitive material and to process these materials in the same manner as above. In these cases, the reducing agent may be incorporated either in the photosensitive material or in the image-receiving material, or used as a solution in water to be supplied to the system.

The amount of water used in this embodiment is as small as at least 0.1 times the weight of the total coating layers of the photosensitive material and image-receiving material, preferably from 0.1 times the weight of the total coating layers of the photosensitive material and image-receiving material to the weight of a solvent corresponding to the maximum swollen volume of the total coating layers (more preferably, up to the weight of a solvent corresponding to the maximum swollen volume of the total coating layers minus the weight of the total coating layers).

Since the swollen coating layers are unstable, there is the likelihood that local oozing would occur. To avoid such local oozing, water is preferably used at most in an amount corresponding to the maximum swollen volume of the total coating layers of the photosensitive material and image-receiving material. Illustratively, water is preferably used in an amount of from 1 to 50 grams, more preferably from 2 to 35 grams, most preferably from 3 to 25 grams per square meter of the combined effective surface areas of the photosensitive material and image-receiving material.

A photographic emulsion layer in the photographic photosensitive material used in the present invention may contain an emulsion or a mixture of two or more emulsions. The emulsion contains a silver halide which may be selected from silver bromide, silver iodide, silver chloride, silver iodobromide, and silver chloroiodobromide, but not limited thereto.

The average particle size of silver halide grains in the emulsion is preferably up to 3 μm although the size is not particularly limited. It is to be noted that the average particle size corresponds to a particle diameter for spherical or near spherical particles or a side length for cubic particles and is represented by an average based on projected areas. The particle size distribution may be either narrow or broad.

For the purpose of obtaining an image having very high sharpness and contrast, the preferred composition of silver halide, when it is free of an organic silver salt, is a silver chlorobromide or silver chlorobromoiodide which consists of about 0.1 mol % to about 9 mol %, preferably about 0.5 mol % to about 5 mol % of bromide and 0 to about 0.2 mol %, preferably 0 to about 0.1 mol % of iodide, with the balance being chloride. When an organic silver salt is copresent, the silver halide composition is not particularly limited. It is desired that the grain size of silver halide ranges from 0.1 to 1.5 μm, especially from 0.1 to 0.5 μm.

The silver halide grains in the photographic emulsions may be grains having a regular crystal form such as cube and octahedron, an irregular crystal form such as sphere and plate, or a composite form of these crystal forms, or a mixture of different crystal form grains. Plate grains may also be used which have a diameter at least 5 times greater than its thickness, provided that the diameter of a grain is the diameter of a circle having an area equal to the projected area of the grain and the thickness is the distance between two approximately parallel major surfaces. One preferred emulsion contains plate grains in an amount occupying at least 50% of the total projected area of grains. The silver halide grains may have a homogeneous phase throughout the grain or be comprised of a core and a shell of different phases. The silver halide grains may be either of the surface latent image type wherein a latent image is predominantly formed on the grain surface or of the internal latent image type wherein a latent image is formed in the grain interior.

The photographic emulsions used in the practice of the present invention may be prepared by generally accepted methods as described in P. Grafkides, "Chimie et Physique Photographique", Paul Montel (1967), G. F. Duffin, "Photographic Emulsion Chemistry", The Focal Press (1966), and V. L, Zelikman et al., "Making and Coating Photographic Emulsion", The Focal Press (1964). More particularly, any methods including acid, neutral and ammonia methods may be used, and the mode of reaction of a soluble silver salt with a soluble halide salt may be single jet mixing, double jet mixing, and a combination thereof.

Also employable is a method of forming silver halide grains in the presence of excess silver ions, which is known as a reverse mixing method. One special type of simultaneous mixing method is by maintaining constant the pAg of a liquid phase in which a silver halide is formed, which is known as a controlled double jet method. This method leads to a silver halide emulsion having a regular crystalline shape and a nearly uniform particle size.

It is possible to mix two or more separately prepared silver halide emulsions.

In the step of forming or physically ripening silver halide grains, there may coexist a cadmium salt, zinc salt, lead salt, thallium salt, iridium salt or its complex salt, rhodium salt or its complex salt, iron salt or its complex salt.

The emulsion is generally removed of soluble salts after precipitation or physical ripening. Soluble salt removal means may be a traditional noodle rinsing method using gelled gelatin or a flocculation method using an inorganic salt of a polyvalent anion (such as sodium sulfate), an anionic surface-active agent, an anionic polymer (such as polystyrene sulfonic acid), or a gelatin derivative (such as aliphatic acylated gelatin, aromatic acylated gelatin, and aromatic carbamoylated gelatin).

The silver halide emulsion may usually be chemically sensitized. Chemical sensitization may be carried out by the methods described in H. Frieser ed., "Die Grundlagen der Photographischen Prozesse mit Silverhalogeniden", Akademische Verlagsgesellschaft, 1968, pages 675–734. For chemical sensitization purpose, there may be employed sulfur sensitization using a sulfur-containing compound capable of reacting with silver ion and active gelatin (such as thiosulfates, thioureas, mercapto compounds and rhodanines), reducing sensitization using a reducing material (such as stannous salts, amines, hydrazine derivatives, formamidine sulfinic acids, silane compounds), noble metal sensitization using a noble metal compound (such as gold complex salts and complex salts of Group VIII metals of the Periodic Table such as Pt, Ir, and Pd), and combinations thereof.

In the practice of the present invention, a silver image which is positive relative to an original image for exposure is obtained when an ordinary negative emulsion is used. A silver image which is negative relative to an original image is obtained when a direct positive emulsion is used.

The silver halides used in the practice of the present invention may be spectrally sensitized with methine dyes and other dyes. The dyes useful for spectral sensitization include cyanine dyes, merocyanine dyes, complex cyanine dyes, complex merocyanine dyes, holopolar cyanine dyes, hemicyanine dyes, styryl dyes, and hemioxonol dyes. Particularly useful dyes among them are cyanine, merocyanine, and complex merocyanine dyes.

For these dyes, any nuclei generally utilized for cyanide dyes can be applied as basic heterocyclic ring nuclei. For example, applicable are pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; and nuclei of the foregoing nuclei having cycloaliphatic hydrocarbon rings fused thereto and nuclei of the foregoing nuclei having aromatic hydrocarbon rings fused thereto, such as indolenine nuclei, benzrndolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. These nuclei may be substituted on carbon atoms.

For the merocyanine and complex merocyanine dyes, 5or 6-membered heterocyclic nuclei are applicable as a nucleus having a ketomethylene structure, for example, a pyrazolin-5-one nucleus, thiohydantoin nucleus, 2-thio-oxazolidine-2,4-dione nucleus, thiazolidine-2,4-dione nucleus, rhodanine nucleus, and thiobarbituric acid nucleus.

The sensitizing dyes may be used alone or in combination. Combinations of sensitizing dyes are often used particularly for the purpose of supersensitization.

Along with the sensitizing dyes, the emulsions may contain dyes which themselves have no spectral sensitization effect or substances which do not substantially absorb visible light, but have the nature of supersensitization. Useful are aminostyryl compounds having a nitrogenous heterocyclic substituent as described in U.S. Pat. Nos. 2,933,390 and 3,635,721, aromatic organic acid-formaldehyde condensates as described in U.S. Pat. No. 3,743,510, cadmium salts and azaindenes.

It is also effective to sensitize up to the infrared region (more than 700 mu).

The most preferred sensitizing dyes are described in Japanese Patent Application No. 58-55694.

An organic silver salt may be used in the practice of the present invention. The organic silver salt can be reduced into silver when heated at a temperature of at least 60° C., preferably at least 80° C. in the presence of an exposed silver halide.

The organic compounds which can be used in the preparation of the organic silver salts include compounds containing a carboxyl group, typically, aliphatic and aromatic carboxylic acids, compounds containing a mercapto or thion group, and compounds containing an imino group.

Typical examples of the aliphatic carboxylic acid silver salts include silver salts derived from behenic, stearic, oleic, lauric, capric, myristic, palmitic, maleic, fumaric, tartaric, furoinic, linolic, linolenic, adipic, sebasic, succinic, acetic, lactic, propiolic, and camphoric acids. Also employable are silver salts derived from halogen or hydroxyl substituted products of these aliphatic acids.

Typical examples of the silver salts of aromatic carboxylic acids and other carboxyl-containing compounds include silver salts derived from benzoic, 3,5-dihydroxybenzoic, o-, m- and p-methylbenzoic, 2,4-dichlorobenzoic, acetamidebenzoic, p-phenylbenzoic, gallic, tannic, phthalic, terephthalic, salicylic, phenylacetic, and pyromellitic acids, 3-carboxymethyl-4-methyl-4-thiazoline-2-thion as disclosed in U.S. Pat. No. 3,785,830, and aliphatic carboxylic acids having a thioether group as disclosed in U.S. Pat. No. 3,330,663.

Typical examples of the compounds containing a mercapto group or a thion group include silver salts derived from 3-mercapto-4-phenyl-1,2,4-triazole, 2-mercaptobenzimidazole, 2-mercapto-5-aminothiadiazole, 2-mercaptobenzothiazole, 2-(s-ethylglycolamide)benzothiazole, thioglycolic acids such as S-alkylthioglycolic acids having an alkyl radical containing 12 to 22 carbon atoms as disclosed in Japanese Patent Application Kokai No. 48-28221, dithiocarboxylic acids such as dithioacetic acid, thioamides, 5-carboxy-1-methyl-2-phenyl-4-thiopyridine, mercaptotriazine, 2-mercaptobenzoxazole, mercaptooxadiazole, mercapto compounds, for example, 1,2,4-mercaptotriazole derivatives such as 3-amino-5-benzylthio-1,2,4-triazole as disclosed in U.S. Pat. No. 4,123,274, and thion compounds such as 3-(2-carboxyethyl)-4-methyl-4-thiazoline-2-thion as disclosed in U.S. Pat. No. 3,301,678.

Typical examples of the compounds containing an imino group include silver salts derived from benzotriazole and its derivatives, for example, benzotriazole, alkylsubstituted benzotriazoles such as methylbenzotriazole, halo-substituted benzotriazoles such as 5-chlorobenzotriazole, 4-hydroxybenzotriazole, 5-nitrobenzotriazole, and carboimidobenzotriazoles such as butylcarboimidobenzotriazole as described in Japanese Patent Publication Nos. 44-30270 and 45-18416; 1,2,4-triazoles and 1Htetrazoles as described in U.S. Pat. No. 4,220,709; and carbazoles, saccharin, imidazoles and derivatives thereof.

Also useful in the practice of the present invention are pyrolyzable silver salts as described in Japanese Patent Application Kokai No. 60-113235 and acetylene silver compounds as described in Japanese Patent Application No. 60-90089.

The combined amount of the photosensitive silver halide and the organic silver salt oxidizing agent coated suitably ranges from about 50 mg/m to 10 g/m$^2$ calculated as silver.

A reducing agent must be present in the practice of the present invention. The reducing agents used herein include p-phenylenediamine type color developing agents, typically N,N-diethyl-3-methyl-p-phenylenediamine as described in U.S. Pat. No. 3,531,286. Other useful reducing agents are aminophenols described in U.S. Pat. No. 3,761,270. Most preferred among the aminophenol reducing agents are 4-amino-2,6-dichlorophenol, 4-amino-2,6-dibromophenol, 4-amino-2-methylphenol sulfate, 4-amino-3methylphenol sulfate, and 4-amino-2,6-dichlorophenol hydrochloride. Research Disclosure, Vol. 151, No. 15108 and U.S. Pat. No. 4,021,240 describe 2,6-dichloro-4-substituted sulfoneamidephenols and 2,6-dibromo-4-substituted sulfoneamidephenols, which are also useful in the present invention. In addition to the phenolic reducing agents described above, naphtholic reducing agents are also useful, for example, 4-amino-naphthol derivatives and 4-substituted sulfonamide naphthol derivatives. Other applicable developing agents are aminohydroxypyrazole derivatives as described in U.S. Pat. No. 2,895,825, aminopyrazoline derivatives as described in U.S. Pat. No. 2,892,74, and hydrazone derivatives as described in Research Disclosure, June 1980, pages 227, 230, 236–240 (RD-19412 and RD-19415).

Other useful reducing agents are hydroquinone, alkylsubstituted hydroquinones such as t-butylhydroquinone, methylhydroquinone, and 2,5-dimethylhydroquinone, catechols, pyrogallols, halogen-substituted hydroquinones such as chlorohydroquinone and dichlorohydroquinone, alkoxysubstituted hydroquinones such as methoxyhydroquinone, and polyhydroxybenzene derivatives such as methylhydroxynaphthalene. Also useful are methyl gallate; ascorbic acid and its derivatives; hydroxylamines such as N,N'-di-(2ethoxyethyl)hydroxylamine; 3-pyrazolidinones such as 1- phenyl-3-pyrazolidinone, 4,4-dimethyl-1-phenyl-3pyrazolidinone, 4-hydroxymethyl-4-methyl-1-phenyl-3pyrazolidinone, 4,4-dimethyl-1-p-tolyl-3-pyrazolidinone, 4- hydroxymethyl-4-methyl-1-p-tolyl-3-pyrazolidinone, 1-p-tolyl-3-pyrazolidinone, 5,5-dimethyl-1-phenyl-3-pyrazolidinone, 4-methyl-1,5-diphenyl-3-pyrazolidinone, 5-methyl1,5-diphenyl-3-pyrazolidinone, 4-methyl-1-phenyl-3pyrazolidone, 5-methyl-1-phenyl-3pyrazolidone, 4,4-dihydroxymethyl-1-phenyl-3-pyrazolidone, 4,4-dihydroxymethyl-1-p-tolyl-3-pyrazolidone, 1,4-diphenyl-3pyrazolidone, 1,5-diphenyl-3-pyrazolidone, 4-methyl-4-hydroxymethyl-1-phenyl-3-pyrazolidone, 4-hydroxymethyl-1-phenyl-3-pyrazolidone, 1-o-tolyl-3-pyrazolidone, 1-m-tolyl-pyrazolidone, 1-p-tolyl-3-pyrazolidone, 4,5-dimethyl-1-phenyl-3-pyrazolidone, 1-p-hydroxyethylphenyl-3pyrazolidone, 1,4-dimethyl-3-pyrazolidone, etc.; reductones and hydroxytetronic acids. These reducing agents may be used alone or in admixture of two or more.

The reducing agent may be used in such a concentration that about 0.01 to about 20 mols, more preferably about 0.1 to about 10 mols of the reducing agent is present per mol of the total of the organic silver salt and silver halide.

Most preferred reducing agents are hydroquinones and 3-pyrazolidinones. A single compound selected from them may be used although a mixture of a hydroquinone and a 3pyrazolidinone is preferred. Exemplary combinations are hydroquinone and 4-hydroxymethyl-4-methyl-1-p-tolyl-3pyrazolidinone, hydroquinone and 4-hydroxymethyl-4-methyl-1-phenyl-3-pyrazolidinone, hydroquinone and 4,4- dihydroxymethyl-1-phenyl-3-pyrazolidinone, and hydroquinone and 4,4-dihydroxymethyl-1-p-tolyl-3-pyrazolidinone. When a mixture of a hydroquinone and a 3-pyrazolidinone is used in a photographic material, the content of hydroquinone in the photographic material is preferably about 0.06 to about 6.3 mols, more preferably from about 0.1 to about 1.5 mols per mol of silver and the content of 3-pyrazolidinone is preferably about 0.006 to about 0.6 mols, more preferably from about 0.02 to about 0.16 mols per mol of silver.

For heat development, it is most preferred to use a 3-pyrazolidone in combination with at least one of nondiffusion reducing agents such as substituted hydroquinones having a ballast group, 4-substituted sulfonamidephenols, 4-aminonaphthol derivatives, and 4-substituted sulfonamidenaphthol derivatives. The nondiffusion reducing agent is contained in a photosensitive material or an image-receiving material, preferably in both whereas the 3-pyrazolidone is contained in the photosensitive material, image-receiving material, or feed water. The content of the nondiffusion reducing agent in the photosensitive material is preferably from about 0.06 to about 6.3 mols, more preferably from about 0.1 to about 1.5 mols per mol of silver. Similarly, the content of the 3-pyrazolidone is preferably from about 0.006 to about 0.6 mols, more preferably from about 0.02 to about 0.2 mols per mol of silver.

In general, a photosensitive layer (I) and an image-receiving layer (II) may be formed either on a common support or on separate supports to produce photosensitive and image-receiving materials. The photosensitive layer (I) and image-receiving layer (II) can be peeled off. For example, a photosensitive material is exposed imagewise and developed by uniform heating or with a processing solution before the image-receiving layer (II) or photosensitive layer (I) is peeled off. Where a photosensitive material is prepared by coating a photosensitive layer (I) on a support and an image-receiving material is separately prepared by coating an image-receiving layer (II) on another support, the photosensitive material is exposed imagewise and developed by uniform heating or with a processing solution, and the image-receiving material is superposed on the developed photosensitive material in order to transfer a mobile silver salt to the image-receiving layer (II). Alternatively, it is also possible to imagewise expose only a photosensitive layer (I) of a photosensitive material, superposing it on an image-receiving layer (II), and then develop.

The image-receiving layer (II) may contain a white reflective layer. For example, a layer having titanium dioxide dispersed in gelatin may be formed on a physical development nuclei-containing layer on a transparent support. The titanium dioxide layer forms a white opaque layer so that a reflective silver image is obtained when the transferred silver image is viewed from the transparent support side.

The photosensitive material and the image-receiving material may be placed in intimate contact by conventional means as by using compression rollers. Heat may be applied during contacting operation in order to insure intimate contact.

The mobile silver salt-receiving layer has physical development nuclei which are contained in a water-soluble binder.

A hydrophilic binder is used in the photographic emulsion of the present invention. Typical of the binders are transparent or semi-transparent hydrophilic colloidal binders. Examples of the binders include natural substances, for example, proteins such as gelatin and gelatin derivatives, cellulose derivatives, starch derivatives, gum arabic, polysaccharides such as dextrin and pluran etc.; and various synthetic polymers, for example water-soluble polyvinyl compounds such as polyvinyl alcohol, polyvinylpyrrolidone, and polyacrylamide. Another synthetic polymer is a dispersible vinyl compound in latex form which increases the dimensional stability of a photographic material. Regenerated cellulose is most effective.

The image-receiving layer having physical development nuclei contained therein may be produced by any desired method, for example, by introducing physical development nuclei into a cellulose ester, particularly cellulose diacetate by evaporation, coating the cellulose ester onto a support, and effecting alkaline hydrolysis; reacting silver nitrate and sodium sulfide, for example, in a cellulose ester solution to form physical development nuclei in situ, coating the solution onto a support, and then effecting alkaline hydrolysis; effecting alkaline hydrolysis of a cellulose ester layer previously coated on a support and simultaneously embedding physical development nuclei in the layer being hydrolyzed; and effecting alkaline hydrolysis of a cellulose ester layer into regenerated cellulose, reacting chloroauric acid and a reducing agent, for example, in the hydrolyzed layer to produce physical development nuclei.

In the practice of the present invention, physical development nuclei are contained in the image-receiving layer. The physical development nuclei serve to reduce a mobile silver salt being diffused from the photosensitive layer into silver to fix in the image-receiving layer.

In addition to physical development nuclei, the image-receiving layer used in the present invention may contain a brightener such as a fluorescent brightener, an anti-stain agent such as boric acid, a surface-active agent as coating aid, a hardener and the like.

The physical development nuclei may be formed of any substances known as forming physical development nuclei in the prior art, for example, heavy metals such as zinc, mercury, lead, cadmium, iron, chromium, nickel, tin, cobalt, and copper; noble metals such as palladium, platinum, silver and gold; and sulfides, selenides and tellurides of these metals. These physical development nuclei-forming substances may be prepared by reducing a corresponding metal ion to form a metal colloid dispersion, or by mixing a metal ion solution with a solution of a soluble sulfide, selenide or telluride to form a colloidal dispersion of a water-insoluble metal sulfide, metal selenide or metal telluride.

It should be understood that no extra physical development nuclei need necessarily be used when a substantially water-insoluble basic metal compound is used in the practice of the present invention. The compound itself or its complex salt plays the role of physical development nuclei.

With respect to the action of physical development nuclei in the silver transfer process, reference is made to Edwin H. Land et al., U.S. Pat. No. 2,774,667 issued Dec. 18, 1956. To obtain an image-receiving element from which a high contrast image can be produced, physical development nuclei are generally distributed in the image-receiving layer in an amount of $10^{-6}$ to 1 g/m$^2$, preferably $10^{-5}$ to $10^{-1}$ g/m$^2$.

For the purposes of increasing sensitivity, enhancing contrast and accelerating development, the photographic emulsion may contain polyalkylene oxides or their derivatives such as ethers, esters, and amines, thioether compounds, thiomorpholines, quaternary ammonium salts, urethane derivatives, urea derivatives, imidazole derivatives, and 3-pyrazolidones.

The photosensitive material used in the practice of the present invention may contain a water-soluble dye as a filter dye or for irradiation prevention or another purpose in a photographic layer or another hydrophilic colloid layer. Examples of the dye include oxonole dyes, hemioxonole dyes, styryl dyes, merocyanine dyes, cyanine dyes, and azo dyes. Among these, oxonole dyes, hemioxolnole dyes and merocyanine dyes are useful. The dye may be mordanted with a cationic polymer such as a dialkylaminoalkyl acrylate in a particular layer.

When a dye or ultraviolet absorber is contained in a hydrophilic colloid layer of a photosensitive material in the practice of the present invention, it may be mordanted with a cationic polymer.

The photographic photosensitive material and image-receiving material used in the practice of the present invention may contain an inorganic or organic hardener in a photographic emulsion layer or any other binder layer. Useful hardeners are chromium salts such as chromium alum and chromium acetate; aldehydes such as formaldehyde, glyoxal, and glutaraldehyde; N-methylol compounds such as dimethylol urea and methylol dimethylhydantoin; dioxane derivatives such as 2,3-dihydroxydioxane; active vinyl compounds such as 1,3,5-triacryloyl-hexahydroxy-s-triazine and 1,3-vinylsulfonyl-2-propanol; active halide compounds such as 2,4-dichloro-6-hydroxy-s-triazine; and mucohalogenic acids such as mucochloric acid and mucophenoxychloric acid, alone or a mixture thereof.

Some preferred non-limiting embodiments of the present invention are illustrated below.

A photosensitive material designed for silver salt diffusion transfer includes at least one silver halide emulsion layer formed on a support, with the amount of silver halide coated being generally in the range of from about 0.5 to 3.5 g/m$^2$ calculated as silver nitrate. In addition to the silver halide emulsion layer, an auxiliary layer may be formed, for example, a primer layer, an intermediate layer, a protective layer, and a release layer. For example, a photosensitive material as used in the present invention may be prepared by coating a silver halide emulsion layer with a layer of a water-permeable binder such as methyl cellulose, sodium carboxymethyl cellulose, and sodium alginate in order to ensure uniform transfer. This coating layer is made thin so as not to substantially prohibit or suppress diffusion. A silver halide emulsion layer in a photosensitive material and an image-receiving layer in an image-receiving material contain a hydrophilic colloid substance, for example, gelatin and gelatin derivatives such as phthalated gelatin, cellulose derivatives such as carboxymethyl cellulose and hydroxymethyl cellulose, dextrin, soluble starch, and hydrophilic high-molecular weight colloid substances such as polyvinylalcohol and polystyrene sulfonate.

In the practice of the present invention, silver salt diffusion transfer is carried out with a processing composition which contains a complexing compound serving as a silver halide solvent such as those previously illustrated; a preservative such as sodium sulfite; a thickener such as carboxymethyl cellulose and hydroxyethyl cellulose; an antifoggant such as potassium bromide; a toning agent such as 1-phenyl-5-mercaptotetrazole; a surface-active agent such as polyoxyalkylene compounds, alkylbenzene sulfonates, and onium compounds; development nuclei such as those described in British Patent No. 1,001,558; and a developing agent such as those previously illustrated. Some of these compounds may be contained in the image-receiving material and/or photosensitive material.

If necessary, an alkaline agent or pH buffer may also be used in combination with these compounds, for example, sodium carbonate, sodium bicarbonate, sodium borate, borax, potassium phosphate, and sodium hydroxide.

The image-forming reaction system in which silver salt diffusion transfer is carried out according to the present invention is at pH about 8 to 14, preferably pH about 9 to 14. Where a substantially water-insoluble basic metal compound is used as previously described, the imageforming reaction system is set to pH about 5 to 14, preferably pH about 7 to 13 before the treatment because the reaction between the basic metal compound and the complexing compound increases the pH of the system. The optimum pH of a particular diffusion transfer treating composition varies depending on the photographic material used, the desired image, the type and amount of various compounds used in the treating composition, and the like.

One preferred embodiment of heat treatment is described below.

The photosensitive material used in this embodiment contains a photosensitive silver halide emulsion layer, a nondiffusion reducing agent, a 3-pyrazolidone reducing agent, a substantially water-insoluble basic metal compound, and optionally, an organic silver salt. The image-receiving material contains a complexing compound and a nondiffusion reducing agent. The photosensitive material in film form is exposed imagewise. Immediately after 12 g/m$^2$ of water is coated on the film surface by bar coating, the wet film is placed in intimate contact with the surface of an image-receiving material film. The assembly is heated by means of a heat presser such that the interface between the contacting film surfaces is held at a temperature of 90° C. for 20 seconds. The photosensitive material is peeled away from the image-receiving material which bears an image thereon.

According to the present invention, a complexing compound is present during a silver salt diffusion transfer treatment. The use of the complexing compound enables to produce a high density, high sensitivity silver image within a short period of time in a simple manner without the need for a conventional silver halide solvent. The use of a substantially water-insoluble basic metal compound in combination with the complexing compound provides an image forming method which ensures easy maintenance of a processing machine and a processing solution used in the method.

EXAMPLES

Examples of the present invention are given below by way of illustration and not by way of limitation.

Example 1

Preparation of Imaqe-Receiving Material

A paper support having polyethylene coated on either surface and a unit weight of 110 g/m$^2$ was coated with a composition of gelatin and carboxymethyl cellulose (weight ratio 4:1) containing metallic palladium nuclei to form an image-receiving layer such that the hydrophilic colloid had a dry weight of 3 g/m$^2$. The image-receiving layer further contained a reducing agent dispersion as described below (1.8 g/m$^2$ of reducing agent), 2.0 g/m$^2$ of $NaS_2O_3$, and $5\times10^{-5}$ mol/m$^2$ of 1-phenyl-5-mercaptotetrazole. There was obtained an image-receiving material (A).

Another image-receiving material designated (B) was prepared by repeating the procedure of (A) except that 3.6 g/m$^2$ of guanidine picolinate was added to the image-receiving layer instead of $Na_2S_2O_3$.

Preparation of reducing Agent Dispersion

A homogeneous solution was prepared by weighing 10 grams of a reducing agent having the structure:

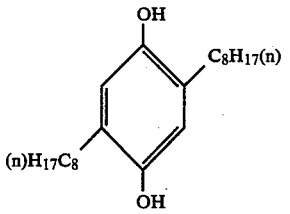

0.5 grams of succinic acid 2-ethylhexyl ester sodium sulfonate surface-active agent, and 2.5 grams of tricresyl phosphate, adding the compounds to 30 ml of ethyl acetate, and heating the mixture at about 60° C. for dissolution. The solution was mixed with 50 grams of an aqueous solution of 10% lime-treated gelatin and the mixture was dispersed by a homogenizer at 10,000 rpm for 10 minutes. The resulting dispersion is designated a reducing agent dispersion.

Preparation of Photosensitive Material

A photosensitive material, sample No. 101 was prepared by coating a paper support which was the same as used for the image-receiving material with a gelatin layer (2.0 g/m$^2$ of gelatin) containing 0.25 g/m$^2$ of carbon black, the reducing agent dispersion (1.8 g/m$^2$ of reducing agent), and 2.0 g/m$^2$ of 4-hydroxymethyl-4-methyl-1-phenyl-3-pyrazolidinone. The support was further coated on the gelatin layer with an orthochromatically sensitized gelatin silver chlorobromide emulsion layer containing 2.0 g/m$^2$ calculated as silver nitrate of silver chlorobromide (silver bromide 2 mol %) having an average grain size of 0.3 μm.

Another photosensitive material, sample No. 102 was prepared by repeating the procedure of sample No. 101 except that the gelatin layer further contained 1.2 g/m$^2$ of zinc hydroxide having an average grain size of 0.2 μm.

Photosensitive material No. 101 was exposed imagewise. On the emulsion layer surface of the photosensitive material, 10% sodium carbonate in water was fed in an amount of 5 ml/m$_2$. The wet material was superposed on image-receiving material (A) or (B) such that the wet emulsion layer surface was held in intimate contact with the image-receiving surface. After one minute the photosensitive material was peeled off from the image-receiving material. Image-receiving material (A) bore thereon a positive image having a maximum density of 2.06 and a minimum density.of 0.28. Image-receiving material (B) bore thereon a positive image having a maximum density of 2.03 and a minimum density of 0.26. Image-receiving material (B) which was free of a silver halide solvent gave results comparable to image-receiving material (A) which contained a silver halide solvent.

Photosensitive material No. 102 was exposed imagewise. On the emulsion layer surface of the photosensitive material water was fed in an amount of 15 ml/m$^2$. The wet material was superposed on image-receiving material (A) or (B) such that the wet emulsion layer surface was held in intimate contact with the image-receiving surface. After one minute the photosensitive material was peeled off from the image-receiving material. Image-receiving material (A) bore substantially no image, but image-receiving material (B) bore thereon a positive image having a maximum density of 2.18 and a minimum density of 0.30. In another run, after photosensitive material No. 102 and image-receiving material (B) were placed in intimate contact by following the same procedure as above, they were uniformly heated for 0 seconds on a heat block at 90° C. Then the photosensitive material was peeled off from image-receiving material (B) which bore thereon a positive image having a maximum density of 2.20 and a minimum density of 0.31.

It is evident that the combination of a complexing compound with a substantially water-insoluble basic metal compound enables a positive image to be formed by feeding only water because the reaction between the compounds yields a base during treatment. Heat treatment shortens the treating time.

EXAMPLE 2

An image-receiving material (C) was prepared by repeating the procedure of image-receiving material (B) in Example 1 except that the metallic palladium nuclei were omitted.

Photosensitive material No. 102 in Example 1 was exposed imagewise. On the emulsion layer surface of the photosensitive material water was fed in an amount of 15 ml/m$^2$. The wet material was superposed on image-receiving material (C) such that the wet emulsion layer surface was held in intimate contact with the image-receiving surface. After one minute the photosensitive material was peeled off from the image-receiving material. In another run, the materials were placed one on another, uniformly heated for 20 seconds on a heat block at 90° C., and then peeled away. The images resulting from both the treatments were approximately equal to the image obtained on image-receiving material (B) in Example 1.

It is seen that when a complexing compound is combined with a substantially water-insoluble compound, the metal ions resulting from the reaction between the compounds are transferred to the image-receiving layer and act there as physical development nuclei, eliminating the need for extra physical development nuclei.

EXAMPLE 3

Preparation of Silver Iodobromide Emulsion

In 3000 ml of water were dissolved 40 grams of gelatin and 26 grams of KBr. The solution was agitated at 50° C. To the solution, a solution of 34 grams of silver nitrate in 200 ml of water was added over 10 minutes, and then another solution of 3.3 grams of potassium iodide in 100 ml of water was added over 2 minutes. The silver iodobromide emulsion thus obtained was pH adjusted such that excess salt precipitated. After removal of the precipitate, the pH was adjusted to 6.0, obtaining a silver iodobromide emulsion in a yield of 400 grams.

Preparation of silver Acetylene Emulsion

In 1000 ml of water and 200 ml of ethanol were dissolved 20 grams of gelatin and 9.2 grams of 4-acetylaminophenylacetylene. The solution was agitated at 40° C. To the solution, a solution of 9.0 grams of silver nitrate in 200 ml of water was added over 5 minutes.

The dispersion was pH adjusted such that excess salt precipitated. After removal of the precipitate, the pH was adjusted to 6.3, obtaining a silver acetylene emulsion in a yield of 300 grams.

A photosensitive material was prepared as follows. An emulsion coating composition was prepared.

| | |
|---|---|
| (a) Silver iodobromide emulsion | 20 g |
| (b) Silver acetylene emulsion | 40 g |
| (c) 1% succinic acid 2-ethylhexyl ester sodium sulfonate in water | 2 ml |
| (d) Gelatin dispersion of reducing agent (prepared in Example 1) | 40 g |
| (e) 10% 1-phenyl-3-pyrazolidone in methanol | 2 ml |

Components (a) to (e) were mixed and dissolved by heating. A polyethylene terephthalate film of 180 um thick was coated with the solution so as to give a wet coating thickness of 80 μm.

A protecting coating solution was prepared by mixing the following ingredients:

| | |
|---|---|
| (f) 10% gelatin in water | 30 g |
| (g) 1% succinic acid 2-ethylhexyl ester sodium sulfonate in water | 10 ml |
| (h) water | 60 ml |

The solution was coated on the photosensitive emulsion layer so as to photosensitive material No. 301.

An image-receiving material (D) was prepared by coating a white polyethylene terephthalate film having TiO2 dispersed therein with a solution of ingredients (i) through (o) shown below so as to give a wet coating thickness of 60 μm, followed by drying.

| | |
|---|---|
| (i) 10% polyvinyl alcohol (degree of polymerization 500) in water | 20 g |
| (j) Urea | 3.2 g |
| (k) N—methyl urea | 4.8 g |
| (l) 10% 1-phenyl-3-pyrazolidone in methanol | 5 ml |
| (m) 30% guanidine picolinate in water | 10 ml |
| (n) Colloidal silver sulfide dispersion (silver sulfide 0.05 g) | 5 g |
| (o) 1% succinic acid 2-ethylhexyl ester sodium sulfonate in water | 2 ml |

Another image-receiving material (E) was prepared by repeating the procedure of image-receiving material (D) except that 10 ml of 10% sodium thiosulfate in water was added as ingredient (m) instead of the 30% guanidine picolinate in water.

Photosensitive material No. 301 was exposed imagewise. The exposed material was superposed on image-receiving material (D) or (E) such that their active surfaces faced each other. The assembly was passed through heat rollers at 130° C. to achieve firm contact and then uniformly heated for 30 seconds on a heat block at 140° C. Immediately after heating, the photosensitive material was peeled away from the image-receiving material which bore a positive image.

A densitometry analysis showed a maximum density of 1.40 and a minimum density of 0.35 for image-receiving material (D), and a maximum density of 1.35 and a minimum density of 0.32 for image-receiving material (E).

It is evident that as in Example 1, a comparable image is obtained with an image-receiving material which is free of a well-known silver halide solvent.

As seen from the results reported above, the image forming method of the present invention can produce an image within a short time in a simple manner even in the absence of a known silver halide solvent. When a complexing compound is used in combination with a substantially water-insoluble basic metal compound, a clear image can be briefly obtained without using extra physical development nuclei.

I claim:

1. A method for forming an image, comprising image-wise exposing a silver halide photosensitive material and subjecting a photographic material comprising said silver halide photosensitive material and an image-receiving material to a silver salt diffusion transfer process in the presence of a reducing agent, a physical developement nucleus, and a complexing compound capable of complexing reaction with a silver ion in the presence of water and/or a hydrophilic thermal solvent as a medium wherein said complexing compound is selected from aromatic heterocyclic compounds having at least one —COOM and containing one nitrogen atom in their ring wherein M is selected from the class consisting of an alkali metal, a guanidine, an amidine, and quaternary ammonium.

2. The image forming method of claim 1 wherein said complexing compound is present in either the silver halide photosensitive material or the image-receiving material in an amount of from 0.01 to 100 mols per mol of silver ion and wherein the silver halide photosensitive material and the image-receiving

3. The image forming method of claim 1 wherein said complexing compound is supplied as a solution in water or in a developer solution in a concentration of from 0.005 to 10 mol/liter.

4. The image forming method of claim I wherein the aromatic heterocyclic compound contains a pyridine or quinoline ring.

5. The image forming method of claim 1 wherein —COOM is attached to the ring at the $\alpha$-position thereof relative to the N atom.

6. The image forming method of claim 1 wherein said complexing compound is selected from compounds having the general formula:

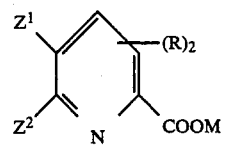

wherein

R represents an electron donative radical selected from the class consisting of hydrogen, an aryl radical, a halogen atom, an alkoxy radical, —COOM, a hydroxycarbonyl radical, an amino or substituted amino radical, and an alkyl radical, the two R's may be the same or different, $Z_1$ and $Z^2$ are as defined for R and may be combined together to form a ring fused to the pyridine ring, and M is selected from the class consisting of an alkali metal, a guanidine, an amidine, and quaternary ammonium.

7. The image forming method of claim 1 wherein said complexing compound is present in an amount of 0.01 to 100 mols per mol of silver ion.

8. The image forming method of claim 1 wherein said reducing agent is selected from a hydroquinone and a 3-pyrazolidinone.

9. The image forming method of claim 1 wherein said physical development nucleus is selected from the group consisting of a heavy metal, a noble metal and a sulfide, a selenide and a telluride thereof.

10. The image forming method of claim 1 wherein said thermal solvent is selected from the group consisting of a urea, a pyridine, an amide, a sulfonamide, an imide, an alcohol, an oxime, and a heterocyclic compound.

11. The image forming method of claim 1 wherein a substantially water-insoluble basic metal compound is also present during the silver salt diffusion transfer process whereby the physical development nucleus is formed in situ by the reaction between the complexing compound and the basic metal compound.

12. The image forming method of claim 11 wherein said substantially water-insoluble basic metal compound is selected from the group consisting of a carbonate salt, a phosphate salt, a silicate salt, a borate salt, an aluminate salt, a hydroxide, an oxide,.and a double salt thereof, provided that it has a solubility in water at 20° C. of 0.5 or less as expressed in grams of the compound dissolved in 100 grams of water.

13. The image forming method of claim 1 which further comprises heating the photographic material during the silver salt diffusion transfer process.

* * * * *

UNITED STATES PATENT AND TRADEMARK OFFICE

CERTIFICATE OF CORRECTION

PATENT NO. : 4,876,171

DATED : October 24, 1989

INVENTOR(S) : Hiroyuki Hirai

It is certified that error appears in the above-identified patent and that said Letters Patent is hereby corrected as shown below:

Claim 2, last line, after "the image-receiving", add --material are both about the same size.--

Signed and Sealed this

Thirtieth Day of April, 1991

*Attest:*

HARRY F. MANBECK, JR.

*Attesting Officer*

*Commissioner of Patents and Trademarks*